US006830109B1

(12) United States Patent
Sprakel

(10) Patent No.: US 6,830,109 B1
(45) Date of Patent: Dec. 14, 2004

(54) METHOD AND DEVICE FOR FIGHTING FIRES

(75) Inventor: Dirk K. Sprakel, Köln (DE)

(73) Assignee: Fogtec Brandschutz GmbH & Co. KG, Cologne (DE)

( * ) Notice: Subject to any disclaimer, the term of this patent is extended or adjusted under 35 U.S.C. 154(b) by 0 days.

(21) Appl. No.: 09/786,637

(22) PCT Filed: Sep. 13, 1999

(86) PCT No.: PCT/EP99/06756

§ 371 (c)(1),
(2), (4) Date: May 1, 2001

(87) PCT Pub. No.: WO00/15301

PCT Pub. Date: Mar. 23, 2000

(30) Foreign Application Priority Data

Sep. 11, 1998 (DE) ..... 198 41 874

(51) Int. Cl.[7] ..... A62C 2/00
(52) U.S. Cl. ..... 169/43
(58) Field of Search ..... 169/43, 45, 46, 169/47, 48, 49, 91

(56) References Cited

U.S. PATENT DOCUMENTS

| | | | | |
|---|---|---|---|---|
| 2,527,891 A | | 10/1950 | Pulver et al. | |
| 2,928,611 A | | 3/1960 | Lauderback et al. | |
| 3,684,019 A | * | 8/1972 | Emmons et al. | 169/47 |
| 5,590,719 A | | 1/1997 | McLoughlin et al. | |

FOREIGN PATENT DOCUMENTS

| | | |
|---|---|---|
| DE | 295 18 911 U | 1/1996 |
| WO | WO 99 32194 | 7/1999 |

* cited by examiner

*Primary Examiner*—Lisa A. Douglas
(74) *Attorney, Agent, or Firm*—Proskauer Rose LLP

(57) ABSTRACT

The invention is for a method for firefighting in which a directed jet of extinguisher foam is applied so as to cover the source of the fire, and to a device suitable for implementing this method. The method and device make it possible to extinguish fires which are spreading in area, while at the same time reducing the risk of uncontrolled spread of the fire. According to the invention, this is achieved in that as a supplement to the jet of extinguisher foam, the apparatus discharges individual jets of a mist of firefighting liquid which cools down the space surrounding the source of the fire.

12 Claims, 1 Drawing Sheet

METHOD AND DEVICE FOR FIGHTING FIRES

BACKGROUND OF THE INVENTION

The invention relates to a method and a device for firefighting, in which a directed jet of extinguisher foam is applied so as to cover the source of the fire. Furthermore, the invention relates to a device which is suitable for implementing the method. Such devices are used in stationary or mobile firefighting units, to suffocate a fire by means of foam, for example if the use of water as a firefighting liquid is not possible.

DESCRIPTION OF THE PRIOR ART

A device suitable for firefighting with extinguisher foam is known from the British printed patent specification 1 018 431. The device described in this printed publication comprises a foam tube, a cylindrical section of which encompasses a nozzle body. The nozzle body comprises a nozzle through which firefighting liquid is applied. To let in the surrounding medium, the known device has an entry aperture at the rear. In addition, several entry apertures are arranged on the cylindrical circumference of the foam tube.

The extinguisher foam generated by means of such a device can be applied in a directional jet. This provides the advantage that the extinguisher foam exits at relatively high kinetic energy thus providing considerable reach. The fire can therefore first be fought from a great distance and subsequently from a lesser distance. At the same time the concentrated application of the jet of extinguisher foam causes the foam to impact on the location of the fire in compact form, forming a thick cover after impact, which cover suffocates the fire.

The strong concentration of the jet of extinguisher foam, which is desirable in view of the ability to cover a long range and achieve good effectiveness of the extinguisher foam, is however problematic in practical applications where fires have to be fought which have spread across large areas or which have established themselves in a substantial, compacted volume such as for example in a stack of wood or paper. Such fires can be fought by a directional jet of extinguisher foam only in that the nozzle is moved to and for during firefighting. As a result of this movement, the jet washes over the surface of the fire, covering it with extinguisher foam after a period of time. Practice shows however that due to the lack of sealing off of the fire and the increased ambient temperature, the spread of the fire to adjacent regions and objects cannot always be prevented.

OBJECTS OF THE INVENTION

It is thus the object of the invention to provide a method of the type described in the introduction and a suitable device for carrying out this method, which make it possible to extinguish fires which are spreading in area, while at the same time reducing the risk of the fire spreading.

Concerning the method, this object is met in that as a supplement to the jet of extinguisher foam, a mist of firefighting liquid is discharged which cools down the space surrounding the source of the fire.

SUMMARY OF THE INVENTION

The method according to the invention combines the firefighting method which is known per se for example from the German utility model 295 18 911.8, using firefighting mist, with the method of firefighting by means of an extinguisher foam. It has been shown that the firefighting mist and the jet of extinguisher foam ideally complement each other, in particular when fighting large-area or large-volume fires. This happens in that as a result of the directional extinguisher jet, the fire is fought directly and the top surface of the fire is gradually covered up with foam. Furthermore, the firefighting mist cools down the gas space which surrounds the fire. Since the firefighting mist covers a significantly larger space than does the jet of extinguisher foam, the application of the firefighting mist results in a lowering of the ambient temperature of the fire also in those regions where direct coverage of the fire by extinguisher foam has not yet taken place, i.e. if the fire in these particular areas is still burning. This prevents the fire from spreading, for example by spontaneous combustion of objects adjacent to the source of the fire, due to the high temperatures in the surroundings of the fire.

It is particularly advantageous if application of the firefighting mist optionally depends on the position of a control device. This makes it possible to match the composition of the firefighting agents (extinguisher foam/mist of firefighting liquid) applied to the region of the source of the fire, to the particular fire situation.

The foam tube can be used particularly advantageously in conjunction with firefighting appliances where the firefighting liquid is applied at high pressure, i.e. at pressures above 40 bar.

A further advantageous embodiment of the method according to the invention is characterized in that a mist of firefighting liquid is applied in the form of several individual jets whose respective origin is in direct proximity to the origin of the jet of extinguisher fluid. Thus it can be ensured in a simple way that most of the mist of firefighting liquid surrounds that section of the fire which is currently covered by the jet of extinguisher foam. For this reason, this embodiment is in particular advantageous in those cases where the method according to the invention is implemented by way of a mobile firefighting appliance in which the firefighter holds a mobile firefighting pistol in his/her hand. In this context it is particularly favourable if part of the individual jets of the mist of firefighting liquid is directed in the direction of the source of the fire, while another part is directed in the perpendicular way, aligned with the axis of the jet of extinguisher foam. In this way, an extended volume of space is filled with the mist of the liquid so that it is not only the space in the immediate vicinity of the fire but also the exhaust gasses rising in the surroundings, that are cooled. It is also favourable if, as a supplement or as an alternative, at least one individual jet is directed in a direction pointing away from the source of the fire so that the rear space too, of the firefighting appliance is sure to be covered by the firefighting mist.

Practical trials have shown that the method according to the invention can be used particularly effectively if the firefighting liquid from which the mist of firefighting liquid is made, is water.

A device which is particularly suitable for implementing the method according to the invention, said device comprising an extinguisher nozzle head which comprises an extinguisher foam generating device for generating a directional jet of extinguisher foam, is characterized according to the invention by the extinguisher nozzle head comprising additional extinguisher nozzles for generating jets of mist of firefighting liquid. In this, preferably at least one of the extinguisher nozzles can be aligned such that the jet of mist of firefighting liquid emanating from it, is directed in the direction of the source of the fire, while at least one further nozzle of firefighting mist is aligned such that the jet of mist of firefighting equipment emanating from it emanates in a direction aligned perpendicularly in relation to the direction of exit of the jet of extinguisher foam.

Further embodiments of the invention are stated in the dependent claims; in the following description of one embodiment they are explained in more detail by means of a drawing.

DETAILED DESCRIPTION OF THE PREFERRED EMBODIMENTS

Figure 1:
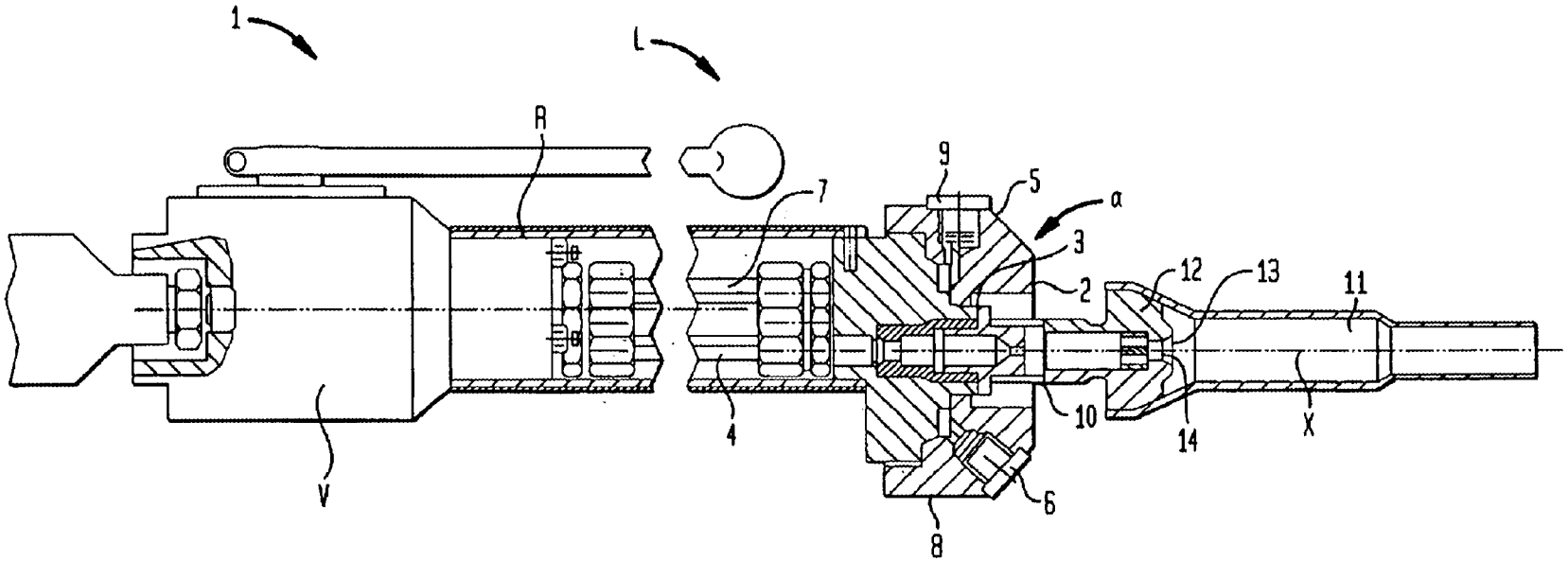
FIG. 1 shows a transportable firefighting pistol L in partial lateral-section view.

The extinguisher nozzle head 1 of the transportable firefighting pistol L is constructed so as to be rotation-symmetrical and at its front comprises a front surface 2. In the centre of the front surface 2, a central extinguisher nozzle 3 is arranged. The central extinguisher nozzle 3 is connected to a first supply line 4 of the firefighting pistol L, said supply line being routed in the tubular housing R of the firefighting pistol L.

Shaped to the front surface 2 of the extinguisher nozzle head 1 is a rotary bevelled surface 5 which recedes at an angle $\alpha$ of approximately 45° in relation to the front surface 2. Extinguisher nozzles 6 are arranged on the bevelled surface 5, said extinguisher nozzles being connected to a second supply line 7 of the firefighting pistol L, which supply line 7 is also routed inside the tubular housing R. The extinguisher nozzles 6 are arranged, at regular angular spacings, on a circle which is arranged concentrically to the aperture of the central extinguisher nozzle 3. The direction of exit of the jet of mist emanating from them if firefighting liquid is applied, is essentially at a right angle to the bevelled surface 5. Consequently, the jets of mist of the extinguisher nozzles 5 are essentially directed in the same direction as the jet which emanates parallel to the longitudinal axis X of the extinguisher nozzle head 1 which is generated by the central extinguisher nozzle 3.

By way of a manually adjustable valve V, firefighting liquid can be supplied to the supply lines 4, 7, either together or individually. Adjacent to the bevelled surface 5 is a radially surrounding casing surface 8 whose axis extends parallel to the longitudinal axis X of the extinguisher nozzle head 1, with further extinguisher nozzles 9, connected to the supply line 7, being arranged on said casing surface. When firefighting liquid is applied to the extinguisher nozzles 9, they also produce a jet of firefighting mist. However, this jet incorporates a component aligned radially to the longitudinal axis X of the extinguisher nozzle head 1 and a component aligned in the direction of the valve V, so that the jets of firefighting mist emanating from the extinguisher nozzles 9 cover the space surrounding the firefighting pistol L rearward and laterally.

On the central extinguisher nozzle 3 a foam tube 11 is attached via a sleeve 10. The foam tube 11 comprises a nozzle body 12 with an injector nozzle 13 projecting into the foam tube 11. The borehole 14 of the injector nozzle 13 is connected to the central extinguisher nozzle 3 via a chamber of the nozzle body 12 and the sleeve 10. Between the wall of the foam tube 11 and the nozzle body 12 there are entry apertures (not shown) through which surrounding air is sucked into the foam tube.

Depending on the position of the valve V, firefighting liquid, preferably water, is supplied to the supply lines 4 or 7, either together or individually. In both supply lines the pressure of the firefighting liquid is in excess of 40 bar. When applying pressure to the supply line 4, the extinguisher nozzles 6 and 9 create a firefighting mist where the individual droplets of liquid are of small volume and issue from the nozzle openings of the extinguisher nozzles 6, 9 into the surroundings finely distributed and at high kinetic energy. The jets of mist emanating from the extinguisher nozzles 6 pointing forward at an angle reach the surroundings of the source of the fire where by evaporation and by accompanying displacement of the oxygen they cool down the gases that are present there. By contrast, the jets emanating from the extinguisher nozzles 9 of the casing surface 8 fill the lateral and rearward space with firefighting mist, so that there too, an efficient reduction in temperature is achieved. This not only prevents the fire from spreading to the cooled-down area, but at the same time it also protects firefighting personnel operating the firefighting pistol.

When pressure is applied to the supply line 7, from the central extinguisher nozzle 3, a directional jet of firefighting liquid mixed with a foam-generating additive, is discharged at high pressure from the central extinguisher nozzle 3. This jet enters the chamber of the nozzle body 12 where it is additionally swirled. By way of injector nozzle 13, the jet of firefighting liquid swirled in this way enters the foam tube 11 into which it sucks up air via the entry apertures of the foam tube, according to the venturi effect. This air mixes with the fine mist of firefighting liquid, creating a fine-pore foam. This foam emanates from the foam tube 11 at high kinetic energy and reaches the source of the fire as a directional, compact jet of extinguisher foam.

The combined action of covering the source of the fire by means of the directional jet of extinguisher foam and cooling the space surrounding the source of the fire by means of the mist of firefighting liquid, considerably reduces the danger of the fire spreading to regions or objects adjacent to the source of the fire. Likewise, lowering of the surrounding temperature reduces the exposure of and danger to, firefighting personnel during firefighting.

To carry out the method according to the invention, preferably water is used as a firefighting liquid. Water mist provides advantages as a result of its excellent thermal binding and inerting properties which, together with the protection from radiated heat which it affords to operating personnel, increase the effectiveness and usefulness of the foam generated by the high pressure foam generator located on the central jet.

It must be pointed out in particular that the foam tube 11 brings about a considerable improvement in the reach of the jet of firefighting agent emanating from it, if no foam-generating additive has been admixed to the firefighting agent, but instead if only the mist of firefighting liquid itself emanates from the foam tube 11 as a jet of high kinetic energy. The use of the foam tube 11 when using liquid without any foam-generating additive, is favourable in those cases when for example, a directional jet of firefighting liquid is required to reach the source of the fire from a considerable distance. Furthermore, the jet of firefighting liquid concentrated by the foam tube 11, can be used to wet hot spots situated deep inside the source of the fire, by applying a well-aimed jet.

What is claimed is:

1. A method for fighting a fire comprising:

directing a jet of extinguisher foam from a firefighting apparatus toward a source of a fire; and in addition to the jet of extinguisher foam, discharging a mist of firefighting liquid onto a region surrounding the source of the fire to cool down this region, wherein said mist of firefighting liquid comprises individual jets whose respective origins on the firefighting apparatus are in direct proximity to the origin of the jet of the extinguisher foam.

2. The method of claim 1, wherein discharging the firefighting mist depends on a position of a control device on said firefighting apparatus.

3. The method of claim 1 wherein the mist comprises water.

4. The method of claim 1 further comprising directing at least one of the individual jets of the mist of the firefighting liquid toward the source of the fire while discharging at least one of the individual jets of the mist of the firefighting liquid in a direction perpendicularly aligned with one axis of the jet of the extinguisher foam.

5. The method of claim 4 further comprising directing at least one of the several individual jets of the mist away from the fire.

6. A firefighting apparatus for fighting a fire comprising:

an extinguisher nozzle head with an extinguisher foam generating device for generating a jet of extinguisher foam, wherein the extinguisher nozzle head comprises additional extinguisher nozzles for generating jets of a mist of a firefighting liquid.

7. The firefighting apparatus of claim 6 further comprising a valve device, wherein said valve device directs the firefighting liquid to at least one of the firefighting mist nozzles and to the extinguisher foam generating device.

8. The firefighting apparatus of claim 6, further comprising a valve device, wherein the valve device directs the firefighting liquid to at least one of the firefighting mist nozzles or to the extinguisher foam generating device.

9. The firefighting apparatus of claim 6 wherein the extinguisher nozzles are arranged around the extinguisher foam generating device, the extinguisher nozzles being regularly spaced apart.

10. The firefighting apparatus of claim 9 wherein the extinguisher nozzles are arranged in a circle whose center coincides with a central axis of the jet extinguisher foam emanating from the extinguisher foam generating device.

11. The firefighting apparatus of claim 6 wherein at least one of the additional extinguisher nozzles is positioned such that its jet of the firefighting liquid is directed toward the source of the fire and at least one further additional extinguisher nozzle of the firefighting liquid is positioned such that its jet of the mist of the firefighting liquid is directed perpendicularly to the direction of exit of the jet of the extinguisher foam.

12. The firefighting apparatus of claim 11 wherein the extinguisher nozzle head comprises:

a radially surrounding casing surface; and a bevelled surface arranged between an essentially plane front surface and the radially surrounding casing surface, said bevelled surface tapering from the radially surrounding casing surface towards the essentially plane front surface wherein several extinguisher nozzles are arranged on the radially surrounding casing surface and the bevelled surface.

* * * * *